United States Patent [19]

Winslow et al.

[11] 4,168,171

[45] Sep. 18, 1979

[54] LIGHT-SENSITIVE THERMAL DEVELOPABLE DIAZOTYPE SHEETS WITH IMIDAZOLES

[75] Inventors: John M. Winslow, South Saint Paul; Gary E. LaBelle, Hugo, both of Minn.

[73] Assignee: Minnesota Mining and Manufacturing Company, Saint Paul, Minn.

[21] Appl. No.: 822,069

[22] Filed: Aug. 5, 1977

[51] Int. Cl.[2] ..... G03C 1/60

[52] U.S. Cl. ..... 96/75; 96/49; 96/91 R

[58] Field of Search ..... 96/49, 75, 91 R

[56] References Cited

U.S. PATENT DOCUMENTS

| | | | |
|---|---|---|---|
| 3,022,716 | 2/1962 | Smith et al. | 355/106 |
| 3,140,645 | 7/1964 | Block et al. | 355/100 |
| 3,199,982 | 8/1965 | Kashiwabara | 96/91 R |
| 3,211,073 | 10/1965 | Fosse et al. | 355/100 |
| 3,294,534 | 12/1966 | Halperin | 96/49 |
| 3,520,691 | 7/1970 | Scheler et al. | 96/49 |
| 3,754,916 | 8/1973 | Winslow et al. | 96/49 |
| 3,910,794 | 10/1975 | Buisine et al. | 96/91 R |

FOREIGN PATENT DOCUMENTS

| | | | |
|---|---|---|---|
| 43-4926 | 2/1968 | Japan | 96/91 R |
| 43-7578 | 3/1968 | Japan | 96/91 R |
| 44-11944 | 5/1969 | Japan | 96/75 |
| 45-18422 | 6/1970 | Japan | 96/91 R |
| 51-73431 | 6/1976 | Japan | 96/75 |

OTHER PUBLICATIONS

Chemical Abstracts, vol. 84, 1976, #158032f, (Motoki et al., Japan Kokai, 75, 138, 821, 11/1975).

Chemical Abstracts, vol. 86, 1977, #163614t, (Saito et al., Japan Kokai, 76, 103, 423, 3/1975).

*Primary Examiner*—Charles L. Bowers, Jr.

*Attorney, Agent, or Firm*—Cruzan Alexander; Donald M. Sell; Mark A. Litman

[57] ABSTRACT

A heat-developable diazotype sheet containing an acid-stabilized diazonium salt in one layer thereof and an acid-neutralizing component in another layer thereof is shown wherein at least 25% by weight of the acid-neutralizer component comprises imidazole derivatives of a specific formula.

4 Claims, No Drawings

LIGHT-SENSITIVE THERMAL DEVELOPABLE DIAZOTYPE SHEETS WITH IMIDAZOLES

Diazotype imaging materials contain at least two active agents and usually require a third active agent to perform well. The first two agents are an acid-stabilized diazonium salt and an azo-coupler compound. The diazonium salt is stabilized against spontaneous reaction with itself and the azo-coupler by the presence of an acid environment. The image produced by diazotype materials is formed from the resulting dye of a reaction between a diazonium salt and the azo-coupler compound. A diazotype sheet containing only these two agents would not be of significant use in competition with modern imaging techniques because a protracted development time would be necessary to overcome the stabilization of the diazonium salt, or reduced amounts of acid would have to be used which would render the sheet less storage stable and reduce the stability of the final image. It has therefore been the practice of the art to add acid-neutralizing compounds (basic materials) to the sheet in order to enable the diazonium salt and the azo-coupler to couple and form a dye more easily. The acid-neutralizing compounds (e.g., ammonia) have commonly been made available for neutralization in various manners including the direct application of gaseous bases (e.g., ammonia), the physical application of liquid bases, or by the application of heat to liberate bases. For example, heat could cause the evolution of acid-neutralizing components (e.g., U.S. Pat. No. 2,732,299) or could enable migration of acid-neutralizing components into a layer containing the acid stabilized diazonium salt by heat softening of a binder or barrier layer (e.g., British Pat. No. 1,032,508). Other methods of contacting the acid-stabilized salt with a neutralizer includes the gross application of a basic material to the surface of the diazonium sheet (e.g., U.S. Pat. No. 3,199,982).

U.S. Pat. No. 3,754,916 discloses that benzimidazole compounds are particularly outstanding as an acid-neutralizer and provides a storage stable material when the benzimidazole compound is included within a heat-softenable binder and also provides excellent imaging characteristics to diazotype sheets. The acid stabilized diazonium salts are separated from the benzimidazole by a heat softenable binder which either is a layer containing the benzimidazole compounds coated next to the layer containing the acid stabilized diazonium salt or else a heat softenable binder layer is used between the respective layers containing the acid stabilized salt and the benzimidazole compound. These benzimidazole compounds provided significant advance in the art, but any improvements thereon would, of course, be desirable.

Typical reaction times for the diazotype sheets shown in U.S. Pat. No. 3,754,916 were at least 40 seconds at 260° F. (126° C.) to react all of the dye forming components in the sheet. This 40 second development time could be shortened by putting less acid into the dye forming coating layer, which results in poor storage properties, or by higher development temperatures which can reduce the resolution of the image. To decrease the development time by these methods was to sacrifice other desirable properties. An alternative method for reducing the development time would be to increase the amount of benzimidazoles in the sheet. This approach is limited by the solubility limits of the benzimidazoles in commonly used solvent systems.

According to the present invention, diazotype elements are disclosed which have good storage stability and which have comparable and good development times for diazotype sheets. Particularly imidazole and imidazole compounds are used as acid-neutralizing agents carried in heat-softenable binder layers in diazotype sheets which form images from acid stabilized diazonium salts and azo-coupler compounds.

Diazonium salts which find utility in this invention are those which are capable of coupling with azo-coupler compounds in weakly basic environments to form dyes. Of the many diazonium salts which may be used in this invention, the following have given good results: p-amino-N-benzyl-N-ethylbenzenediazonium chlorostannate, p-amino-N-benzyl-N-ethylbenzenediazonium chloro-zincate, 3-chloro-4-diethylaminobenzenediazonium chlorozincate, p-diethylaminobenzenediazonium fluoroborate, p-diethylamino-2-ethoxybenzenediazonium chlorozincate, 4-diethylamino-2-methylbenzenediazonium chlorozincate, p-morpholinobenzenediazonium fluoroborate, p-diazo-N-methyl-N-hydroxyethylaniline zinc chloride, p-diazo-N-ethyl-o-toluidine zinc chloride, p-diazo-N-diethyl-m-phenetidine zine chloride, p-diazomorpholino-2,5-diethoxybenzene zinc chloride, p-diazomorpholino-2,5-dibutoxybenzene boro fluoride, p-diazo(4'-toluyl)mercapto-2,5-dimethoxybenzene zinc chloride, 4-diazo-1',2,5-triethoxydiphenyloxalate, p-diazomorpholino-2,5-dibutoxybenzene zinc sulfate, p-diazodimethyl aniline 1/1-$ZnCl_2$, p-diazo diethyl zniline zinc chloride, p-diazo-N-hydroxyethyl-N-ethylaniline-½ zinc chloride, p-diazo-N-ethyl-N-benzylaniline zinc chloride, 4-diazophenylmorpholine zinc chloride, 1-diazo-4-benzoylamino-2,5-diethoxybenzene zinc chloride. Preferred diazonium salts include: p-diazomorpholino-2,5-dibutoxybenzene borofluoride, p-diazomorpholino-2,5-dibutoxybenzene zinc sulfate, 4-diazophenylmorpholine zinc chloride. Light-sensitive diazonium salts are preferably used.

Azo-coupling compounds which find utility in this invention are those which will couple with diazonium salts in weakly basic environments to form dyes. Such couplers include: 2,3-dihydroxy naphthalene, 2,3-dihydroxynaphthalene-6-sulfonic acid sodium salt, 2,7-dihydroxynaphthalene, 1,7-dihydroxynaphthalene, phloretin, acetoacetanilide, aceto-acet-o-ansidide, 3-methyl-p-sulfophenyl-5-pyrazolone, aceto-acet-2,5-dimethoxyanilide, aceto-acet-p-toluidide, aceto-acet-2,4-xylidide, 2,6-dihydroxy toluene, 3-methyl-1-phenyl-5-pyrazolone, 2'-chloroacetanilide, ethylenediaminebisacetoacetamide, N,N-ethylenebisacetoacetamide, $\gamma$-naphtol, $\beta$-naphtol, 1,4-dihydroxynaphthalene. Azo-couplers commonly used in the dying of textiles have proven especially useful, such as the following: 3-hydroxy-2-naphtho-o-phenetidide, 3-hydroxy-2-naphtho-o-toluidide, 5'-chloro-3-hydroxy-2',4'-dimethoxy-2-naphthanilide, 3-hydroxy-2',5-dimethoxy-2-naphthanilide, 3-hydroxy-2-naph-o-anisidide. Light-sensitive azo-coupler compounds may be used, as taught in U.S. Pat. No. 3,094,417.

Two or more azo-coupler compounds may be incorporated within the diazotype sheet of the present invention to produce dyes which together exhibit desirable spectral absorption characteristics. For example, in a preferred embodiment, the dyes resulting from the coupling of p-diazomorpholino 2,5-diethoxy boro fluoride with acetoacetanilide, 2,3-dihydroxy-naphthalene, and 3-hydroxy-2-naphtho-o-toluidide are yellow, reddishpurple, and cyan, respectively, and together form substantially black images.

It is often desirable to incorporate acidic compounds, such as oxalic acid, in in layers sheets which contain highly-reactive diazonium salts for the purpose of inhibiting self-coupling reactions. Diazotype sheets which contain less highly-reactive diazonium salts generally require proportionately reduced amounts of acidic compounds, and many diazonium acid-salts exhibit sufficient stability without the addition of other acidic compounds.

A binder material, normally polymeric, is preferably used to contain the reactive components inlayers in the diazotype sheets of the present invention. The binder materials and barrier materials are preferably thermoplastic and soften sufficiently at reasonable development temperatures to permit imidazole compounds to readily migrate therethrough. Thermoplastic binder materials in addition should be sufficiently rigid at normal storage temperatures to hinder such migration. It is desirable that the binder materials used in the present invention be capable of forming continuous films. Examples of such polymeric binder materials include polyvinyl chloride acetate, polystyrene, polymethylmethacrylate, etc. Such binder materials are preferably chosen to be compatible with the components incorporated therein, i.e., capable of forming a single phase system with such components, and permit the ready migration of imidazole compounds therethrough upon heating. However, polymeric binder materials which are incompatible with the components contained therein, such as polymeric latices, may often be advantageously utilized. Binder materials which permit the migration therethrough of chemical compounds such as imidazole compounds, couplers, and the like are generally known to the art, and the selection therefrom is not critical to the present invention.

The supporting substrates for the layers of the present invention may be or any suitable material such as plastic film, glass, paper, metal, cloth, wood, etc. Plastic films, such as polyester and cellulose triacetate, are preferred. The substrates desirably should have a heat-distortion temperature sufficiently high to permit reasonable development temperatures to be used without damage thereto. It is contemplated, however, that substrates having lower heat-distortion temperatures may be desirable, as, for example, when a wrinkled design pattern is desired. It is further contemplated that a separate supporting layer may be advantageously eliminated in some cases, as when at least one of the binder materials is a self-supporting film.

The diazotype sheets of the present invention may be prepared by a variety of methods, such as consecutively coating polymer emulsions containing reactive components upon a substrate to form layers; laminating together reactive component-containing layers, etc. Preferably, however, the reactive components and polymeric binder material for each layer are combined in a solution which is coated and dried to form a layer. The solvent for each solution is preferably a non-solvent for the binder material of the preceding layer, thereby avoiding the migration which might otherwise occur should a solvent be capable of dissolving the binder material of the preceding layer to liberate the reactive components contained therein.

Imidazole acid-neutralizer compounds are represented by the formula:

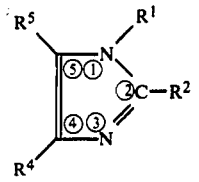

wherein $R^1$=H, phenyl, benzyl, and cyanoalkyl ($C_1$–$C_8$);

$R^2$=H, $C_1$–$C_8$ alkyl, $C_1$–$C_8$ alkoxy, hydroxy, amine, cyano, phenyl, and benzyl;

$R^4$=H, $C_1$–$C_8$ alkyl, $C_1$–$C_8$ alkoxy, phenyl, and benzyl; and $R^5$=H, $C_1$–$C_8$ alkyl, $C_1$–$C_8$ alkoxy, phenyl, and benzyl, wherein there are no more than two aromatic groups present as substituents on the imidazole nucleus.

The 4- and 5-positions on the imidazole nucleus are equivalent due to tautomerization of the 1–2 N-C bond and the 2–3 C=N bond.

The most preferred neutralizers of the present invention are those represented by the above formula wherein:

$R^1$=H, phenyl, and benzyl $R^2$=H, alkyl ($C_1$–$C_8$), phenyl, and benzyl $R^4$=H, alkyl ($C_1$–$C_8$), phenyl, and benzyl $R^5$=H, alkyl ($C_1$–$C_8$), phenyl, and benzyl, wherein there are no more than two aromatic substituents on the imidazole nucleus and wherein at least the 2- or 4-(5-) position must be substituted.

The neutralizing imidazoles of the present invention may be used as part of the neutralizing additives in a diazotype sheet or as the sole component. It has been found desirable to have at least 25% by weight of all acid-neutralizing materials in the sheet comprised of the imidazoles of the present invention. A composition comprising at least 50% of the imidazoles of the invention as the acid-neutralizer material is more preferred, and a 75% minimum is most preferred. Benzimidazole or other known acid-neutralizer materials may be used to make up the remaining percentages. The following examples will assist in an understanding of the present invention.

EXAMPLES 1–25

Two standard coating solutions were prepared as a basis for the comparison and evaluation of neutralizing agents for the thermal diazo sheets. The first solution comprised:

20.00 g vinylchloride-vinyl acetate (50/50) copolymer
44.60 g methylisobutylketone
23.07 g acetone
9.70 g cyclohexanone
0.30 g 2,3-dihydroxynaphthalene
0.18 g o-acetoacetanisidide
0.15 g acetoacet-o-chloroanilide A second coating solution was formulated as follows:

7.00 g polyvinyl butyral
70.33 g methanol
20.00 g n-butanol
0.44 g 3-hydroxy-2'-methyl-2-naphthanilide-o-toluidide
0.44 g 3-oxynaphthoic acid-o-phenetidide
0.45 g 5-sulfosalicyclic acid 1.34 g p-diazo-2,5-diethoxy-4-morpholino benzene borofluoride In the standard for these comparisons, 2.00 g of benzimidazole were added to the first coating solution. In all other examples, equal molar proportions of the neutralizer agents were added. The first solution was coated on polyester film then dried to a coating weight of 1.15 g/ft$^2$ by heating to 95° C. for two minutes. The second coating was applied and dried to 0.38 g/ft$^2$ by heating at 49° C. for 2.5 minutes. Development was effected by heating at 127° C. The maximum optical density was measured, and the time to reach that maximum density was recorded. Samples were natural aged at ambient conditions (20°-25° C., 30-60% relative humidity) or with accelerated aging (converted to natural age equivalent units) and the Dmin and Dmax measured after development. The results are as follows:

| Compound | Dmax | Seconds to Dmax | Shelf Aging | Molar Equivalents | Example |
|---|---|---|---|---|---|
| Benzimidazole | 2.00 | 40 | V.G. | 1.00 | 1 (Standard) |
| Imidazole (IMZ) | 1.40 | 30 | V.G. | 1.00 | 2 |
| 2-methyl IMZ | 2.00 | 6 | P | 1.00 | 3 |
| 2-ethyl IMZ | 2.30 | 12 | P | 2.00 | 4 |
| | 2.20 | 2 | P | 6.10 | 5 |
| 2-propyl IMZ | 2.30 | 10 | F | 2.00 | 6 |
| | 2.20 | 5 | P | 4.00 | 7 |
| | 2.20 | 2 | P | 8.00 | 8 |
| 2-isopropyl IMZ | 1.75 | 40 | E | 1.00 | 9 |
| | 2.30 | 20 | E | 2.00 | 10 |
| 2-phenyl IMZ | 1.95 | 60 | E | 1.00 | 11 |
| 2-benzyl IMZ | 2.00 | 16 | E | 1.00 | 12 |
| 2-cyano IMZ | 1.10 | 60 | V.G. | 1.00 | 13 |
| 4-phenyl IMZ | 2.00 | 30 | V.G. | 1.00 | 14 |
| 4-methyl IMZ | 1.95 | 16 | V.G. | 1.00 | 15 |
| 2-ethyl-4-methyl IMZ | 1.35 | 20 | V.G. | 1.00 | 16 |
| 2,4-dimethyl IMZ | 2.12 | 20 | V.G. | 1.00 | 17 |
| | 2.05 | 10 | V.G. | 2.00 | 18 |
| 2-phenyl-4-methyl IMZ | 2.05 | 30 | V.G. | 1.00 | 19 |
| 1-benzyl-2-methyl IMZ | 1.92 | 10 | P | 1.00 | 20 |
| 1-benzyl-2-phenyl IMZ | 1.95 | 6 | P | 1.00 | 21 |
| 1-cyanoethyl-2-methyl IMZ | 1.90 | 20 | P | 1.00 | 22 |
| 1-cyanoethyl-2-phenyl IMZ | 1.86 | 40 | P | 1.00 | 23 |
| 1-cyanoethyl-2-ethyl-4-methyl IMZ | 1.95 | 15 | P | 1.00 | 24 |
| 2,4,5-trimethyl IMZ | 1.95 | 15 | V.G. | 1.00 | 25 |

P = less than 3 months shelf stability
F = less than 6 months shelf stability
V.G. = 6 to 9 months shelf stability
E = more than 9 months shelf stability
Shelf stability has ended when visible precoupling occurs without heat development.

It can be readily seen that the acid-neutralizers of the present invention display varying degrees of shelf stability and rapid development in thermal diazo elements. Some diazo materials, using neutralizers of the present invention, with poor shelf stability and very rapid development times may improve their shelf life by reducing the concentration of neutralizer without losing all of the improvement in speed.

The most preferred compounds are the 2-substituted imidazoles where the substituent is alkyl group of 3 to 8 carbon atoms, phenyl group (which includes substituted phenyl), and benzyl group (which includes substituted benzyl).

What is claimed is:

1. A heat reactive diazotype sheet having a supporting substrate having at least two layers thereon, one of said layers comprising a heat-softenable binder material and an acid-stabilized light sensitive diazonium salt capable of reacting with an azo-coupler compound to form a dye, and the other of said layers comprising a heat-softenable binder material and an acid-neutralizer component capable of providing basic equivalents in an amount at least sufficient to neutralize said acid stabilization of said diazonium salt so as to provide a weakly basic environment for the diazonium salt in the sheet and to render said acid-stabilized diazonium salt reactive with said azo-coupler compound, and at least one of said layers containing an azo-coupler, said diazotype sheet being characterized by said acid-neutralizer component being comprised of at least 25% by weight imidazole acid-neutralizer compound is selected from the group consisting of 2-isopropyl imidazole, 2-phenyl imidazole, 2-benzyl imidazole, 4-phenyl imidazole, 4-methyl imidazole, 2,4-dimethyl imidazole, 2-phenyl-4-methyl imidazole, and 2,4,5-trimethyl imidazole.

2. The heat reactive diazotype sheet of claim 1 wherein at least 50% by weight of said acid neutralizer component is an imidazole acid-neutralizer compound.

3. The heat reactive diazotype sheet of claim 1 wherein at least 75% by weight of said acid neutralizer component is an imidazole acid-neutralizer compound.

4. The heat reactive diazotype sheet of claim 1 wherein said imidazole acid-neutralizer component is selected from the group consisting of 2-isopropyl imidazole, 2-phenyl imidazole, and 2-benzyl imidazole.

* * * * *

UNITED STATES PATENT AND TRADEMARK OFFICE

CERTIFICATE OF CORRECTION

PATENT NO. : 4,168,171

DATED : September 18, 1979

INVENTOR(S) : John M. Winslow and Gary E. LaBelle

It is certified that error appears in the above-identified patent and that said Letters Patent are hereby corrected as shown below:

Column 3, line 4, "in in layers sheets" should be --in diazotype sheets--;

Column 3, line 13, "inlayers" should be --in layers--; and

Column 5, line 2, "borofluoride In the" should be --borofluoride.-- and "In the" should start a new paragraph.

Signed and Sealed this

*Twenty-ninth* Day of *January 1980*

[SEAL]

*Attest:*

SIDNEY A. DIAMOND

*Attesting Officer*

*Commissioner of Patents and Trademarks*